US007883190B2

(12) United States Patent
Kawase

(10) Patent No.: US 7,883,190 B2
(45) Date of Patent: Feb. 8, 2011

(54) DROPLET DISCHARGE APPARATUS

(75) Inventor: Tomomi Kawase, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 156 days.

(21) Appl. No.: 12/392,520

(22) Filed: Feb. 25, 2009

(65) Prior Publication Data

US 2009/0244115 A1 Oct. 1, 2009

(30) Foreign Application Priority Data

Mar. 26, 2008 (JP) ..... 2008-080656

(51) Int. Cl.
*B41J 2/175* (2006.01)

(52) U.S. Cl. ..... 347/85; 347/6; 347/7

(58) Field of Classification Search ..... 347/5–7, 347/85

See application file for complete search history.

(56) References Cited

U.S. PATENT DOCUMENTS 7,036,906 B2 5/2006 Takano et al.
2008/0238957 A1* 10/2008 Hayashi ..... 347/7

FOREIGN PATENT DOCUMENTS

JP H09-277561 A 10/1997
JP 2004-122112 A 4/2004
JP 2006-159073 A 6/2006
JP 2008-55699 A 3/2008
WO WO-2008/149652 A1 12/2008

* cited by examiner

*Primary Examiner*—Ellen Kim
(74) *Attorney, Agent, or Firm*—Global IP Counselors, LLP

(57) ABSTRACT

A droplet discharge apparatus includes: a tank for storing a function liquid; a first supply tube for supplying the function liquid; a plurality of pressure control valves for controlling a pressure of the function liquid supplied from the tank via the first supply tube, to a predetermined pressure and then letting out the function liquid; a plurality of droplet discharge heads for discharging the function liquid let out from the pressure control valves in the form of droplets; and a plurality of second supply tubes for connecting outlets of the pressure control valves and inlets of the droplet discharge heads so that the function liquid let out from the pressure control valves is supplied to the droplet discharge heads. Distances between the outlets and the corresponding inlets are different from one another, and lengths of the second supply tubes are equalized so that resistances of flow paths between the outlets and the corresponding inlets are equalized.

6 Claims, 6 Drawing Sheets

DROPLET DISCHARGE APPARATUS

BACKGROUND

1. Technical Field

The present invention relates to a droplet discharge apparatus.

2. Related Art

A droplet discharge apparatus for discharging a liquid in the form of droplets is known as an apparatus for forming a desired pattern on a substrate. A droplet discharge apparatus includes a substrate placed on a stage and a droplet discharge head for discharging a liquid in the form of droplets, and forms a pattern by disposing droplets discharged from the droplet discharge head in desired positions on the substrate while the droplet discharge head scans the substrate.

In order to form a high-resolution pattern on a substrate using a droplet discharge apparatus, the amounts of droplets discharged from nozzles of the droplet discharge head must be highly uniform. For this reason, a pressure control valve is provided between an ink tank for storing a liquid and a droplet discharge head in the droplet discharge apparatus so that the pressure applied to the liquid to be supplied to each droplet discharge head is controlled. As a configuration for providing such a pressure control valve, JP-A-09-277561 proposes that a pressure control valve be directly connected to a droplet discharge head so that the size of the apparatus is reduced.

Incidentally, in a large-scale, industrial droplet discharge apparatus used when manufacturing large display panels or the like, multiple droplet discharge heads are disposed on one carriage so as to reduce the frequency with which a large substrate is scanned. In order for each droplet discharge head mounted on the carriage to draw a fine pattern of several tens of micrometers, the relative positions among the droplet discharge heads and the positions of the droplet discharge heads relative to the carriage must be highly accurate.

In order to obtain such position accuracy when mounting the above-mentioned droplet discharge heads on the carriage, first, the positions of the droplet discharge heads relative to the carriage are optically detected and then the positions of the droplet discharge heads are fine-tuned on the basis of the detected positions. If the positions of the droplet discharge heads and the corresponding target positions are optically matched, the droplet discharge heads and the carriage are instantly bonded together using an adhesive material.

On the other hand, if the droplet discharge head described in JP-A-09-277561 is mounted on a carriage, a pressure control valve is directly connected to the droplet discharge head. Accordingly, the load imposed on the droplet discharge head is increased. This makes it difficult to fine-tune the position of the droplet discharge head. Also, the adhesiveness between the droplet discharge head and carriage is significantly deteriorated. Accordingly, the droplet discharge head is significantly displaced from the target position. In order to prevent such displacements of the droplet discharge heads in the above-mentioned large-scale, industrial droplet discharge apparatus, the droplet discharge head and corresponding pressure control valves must be separated.

However, if the droplet discharge heads and corresponding pressure control valves are separated, the pressures applied to a liquid are dropped in tubes connecting the outlets of the pressure control valves and the inlets of the corresponding droplet discharge heads. Accordingly, the supply pressure of the liquid to each droplet discharge head varies with tubes. While it seems that such a problem can be solved by equalizing the distances between the outlets of the pressure control valves and inlets of the corresponding droplet discharge heads, the size of the apparatus is increased, since the positions of the droplet discharge heads and the positions of the pressure control valves are significantly restricted.

SUMMARY

An advantage of the invention is to provide a droplet discharge apparatus that improves the uniformity in the amounts of droplets discharged from droplet discharge heads regardless of the positions of the droplet discharge heads.

A droplet discharge apparatus according to a first aspect of the invention includes: a tank for storing a function liquid; a first supply tube for supplying the function liquid; a plurality of pressure control valves for controlling a pressure of the function liquid supplied from the tank via the first supply tube, to a predetermined pressure and then letting out the function liquid; a plurality of droplet discharge heads for discharging the function liquid let out from the pressure control valves in the form of droplets; and a plurality of second supply tubes for connecting outlets of the pressure control valves and inlets of the droplet discharge heads so that the function liquid let out from the pressure control valves is supplied to the droplet discharge heads. Distances between the outlets and the corresponding inlets are different from one another, and lengths of the second supply tubes are equalized so that resistances of flow paths between the outlets and the corresponding inlets are equalized.

By adopting the droplet discharge apparatus according to the first aspect of the invention, the flow path resistances in the second supply tubes are equalized. Accordingly, the supply pressures of the function liquid supplied from the pressure control valves to the corresponding droplet discharge heads are equalized. As a result, the droplet discharge apparatus according to the first aspect of the invention is allowed to improve the uniformity in the amounts of droplets discharged from the droplet discharge heads.

In the droplet discharge apparatus according to the first aspect of the invention, the tank preferably supplies different types of function liquids to the pressure control valves, and lengths of the second supply tubes are equalized with respect to each of the types of the function liquids.

By adopting the above-mentioned droplet discharge apparatus, the pressure control valves and corresponding droplet discharge heads are coupled via second supply tubes having an identical flow path length for each of the types of function liquids. Accordingly, the flow path resistances are equalized for each of types of function liquid. Therefore, an identical type of function liquid is supplied to corresponding droplet discharge heads under a uniform supply pressure. As a result, the uniformity in discharge amounts of an identical type of function liquid is improved.

In the droplet discharge apparatus according to the first aspect of the invention, the lengths of the second supply tubes are preferably equalized for all the types of function liquids.

By adopting the above-mentioned droplet discharge apparatus, the pressure control valves and corresponding droplet discharge heads are coupled via second supply tubes having an identical flow path length with respect to all the types of function liquids. As a result, the uniformity in discharge amounts is improved with respect to all the types of function liquids.

In the droplet discharge apparatus according to the first aspect of the invention, an inner diameter of each of the second supply tubes is preferably larger than an inner diameter of the first supply tube connecting the tank and the pressure control valves.

By adopting the above-mentioned droplet discharge apparatus, each second supply tube connected to the downstream side of the corresponding pressure control valve is made larger than the corresponding first supply tube connected to the upstream side of the pressure control valve. Accordingly, pressure loss per unit length in each second supply tube located downstream of the pressure control valve is made smaller than that in the first supply tube located upstream. Accordingly, the function liquid whose pressure has been controlled to a predetermined pressure by each pressure control valve is supplied to the corresponding droplet discharge head in such a manner that the predetermined pressure is maintained.

In the droplet discharge apparatus according to the first aspect of the invention, the largest distances in a vertical direction between the second supply tubes and the corresponding droplet discharge heads are preferably equalized.

By adopting the above-mentioned droplet discharge apparatus, the water heads of the function liquid to the droplet discharge heads are equalized with respect to all the second supply tubes. As a result, unevenness in the supply pressures of the function liquid is prevented.

In the droplet discharge apparatus according to the first aspect of the invention, each of the droplet discharge heads preferably has a plurality of nozzles for discharging the droplets and a plurality of flow paths for connecting the nozzles and the corresponding inlet, and resistances of the flow paths are preferably equalized.

Since the resistances of the flow paths between the inlet and nozzles are equalized in the droplet discharge heads of the above-mentioned droplet discharge apparatus, unevenness in discharge amounts among the nozzles is further prevented in the multiple droplet discharge heads.

BRIEF DESCRIPTION OF THE DRAWINGS

The invention will be described with reference to the accompanying drawings, wherein like reference numerals designate like elements.

DESCRIPTION OF EXEMPLARY EMBODIMENT

An embodiment of the invention will be described with reference to FIGS. 1 to 7. The directions of X axes, directions of Y axes, and directions of Z axes shown in FIGS. 1 to 6 are the same as the direction of an X axis, the direction of a Y axis, and the direction of a Z axis, respectively, shown in FIG. 1.

Figure 1:
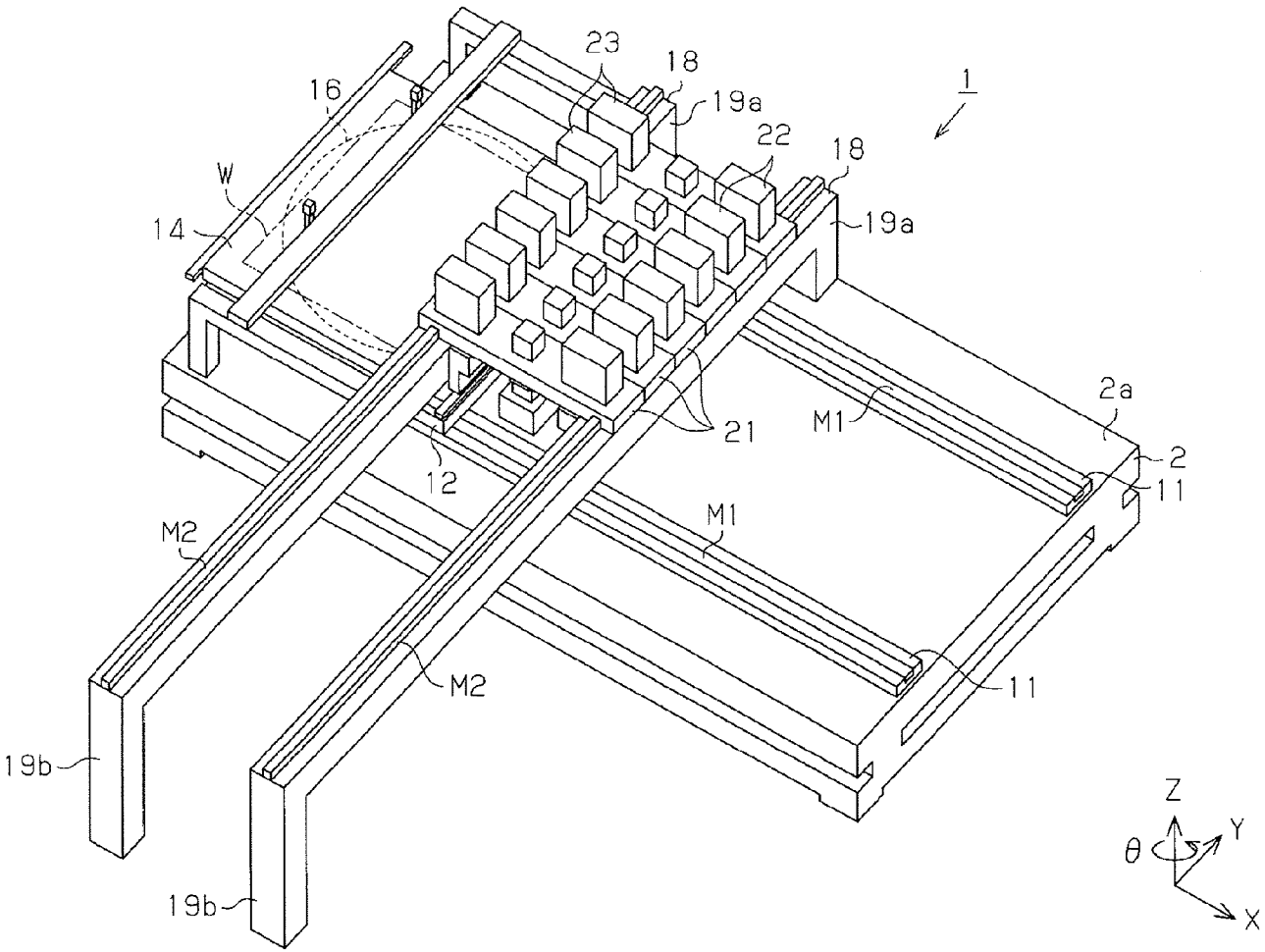
FIG. 1 is a perspective view roughly showing a configuration of a droplet discharge apparatus.

FIG. 1 roughly shows a configuration of a droplet discharge apparatus 1 for forming color filters for red, green, and blue on a glass substrate. In the droplet discharge apparatus 1, a pair of X axis guide rails 11 are laid on an upper surface 2*a* of a base 2 extending in the main scan direction (X axis direction), along the main scan direction (X axis direction). Mounted on the pair of the X axis guide rails 11 is an X axis moving plate 12 movable in the main scan direction along the X axis guide rails 11. The pair of X axis guide rails 11 are each provided with an X axis linear motor M1. The X axis linear motors M1 cause the X axis moving plate 12 placed on the pair of X axis guide rails 11 to reciprocate in the X axis direction via an air slider (not shown).

In FIG. 1, the X axis direction represents the main scan direction, the Y axis direction represents the sub-scan direction perpendicular to the main scan direction (X axis direction), the Z axis direction represents a direction (vertical direction) perpendicular to the X axis direction and Y axis direction, and a θ direction represents a rotation direction about the Z axis.

Provided on the upper surface of the X axis moving plate 12 is a substrate stage 14. The substrate stage 14 is a vacuum absorption table and fixes, to the upper surface thereof, a color filter substrate (hereafter simply referred to as a "CF substrate W") made of a glass substrate by absorbing the CF substrate W and carries the CF substrate W. The substrate stage 14 is supported and fixed to the X axis moving plate 12 by a stage rotation mechanism 16 that is provided between the X axis moving plate 12 and substrate stage 14 and is indicated by a dotted line, in such a manner that the substrate stage 14 is rotatable in the θ direction.

The substrate stage 14 moves in the X direction together with the X axis moving plate 12 to carry the CF substrate W in the X axis direction. Also, the substrate stage 14 rotates about the Z axis in the θ direction so as to rotate the CF substrate W in the θ direction.

A pair of Y axis guide rails 18 are disposed above the X axis guide rails 11 in such a manner that the Y axis guide rails 18 straddles the X axis guide rails 11 in the Y axis direction. Columns 19*a* provided at one edges of the Y axis guide rails 18 are disposed upright on a side of the upper surface 2*a* of the base 2, and columns 19*b* provided at the other edges of the Y axis guide rails 18 are disposed on the floor distant from the base 2. The pair of Y axis guide rails 18 are disposed in parallel in the X axis direction at a predetermined interval. In this embodiment, as for the pair of Y axis guide rails 18 extending in parallel with the Y axis direction, an upper area of the base 2 is referred to as a work area and an area distant from the base 2 is referred to as a standby area.

Multiple carriage plates 21 are provided over the pair of Y axis guide rails 18. The carriage plates 21 are placed in such a manner that the carriage plates 21 is movable along the Y axis guide rails 18 in the Y axis direction. The pair of Y axis guide rails 18 are each provided with a Y axis linear motor M2. The Y axis linear motors M2 cause the carriage plates 21 placed on the pair of Y axis guide rails 18 to reciprocate in the Y axis direction via an air slider (not shown). The carriage plates 21 reciprocate between the working area and standby area above the Y axis guide rails 18 while receiving the driving force of the Y axis linear motors M2.

Placed on the upper surfaces of the carriage plates 21 are function liquid supply units 22 and electrical units 23 for head. The function liquid supply units 22 store a function liquid F (see FIG. 6) and provide the function liquid F to droplet discharge heads 40 (see FIG. 5). The electrical units 23 for head provide drive signals to drive the droplet discharge heads 40.

The function liquid F is ink for forming color filters for the above-mentioned colors. Any one of the three types of ink is provided to each droplet discharge head 40. The function liquid F is discharged onto the CF substrate W and dried. Thus, the function liquid F becomes color filters for the colors.

Figure 2:
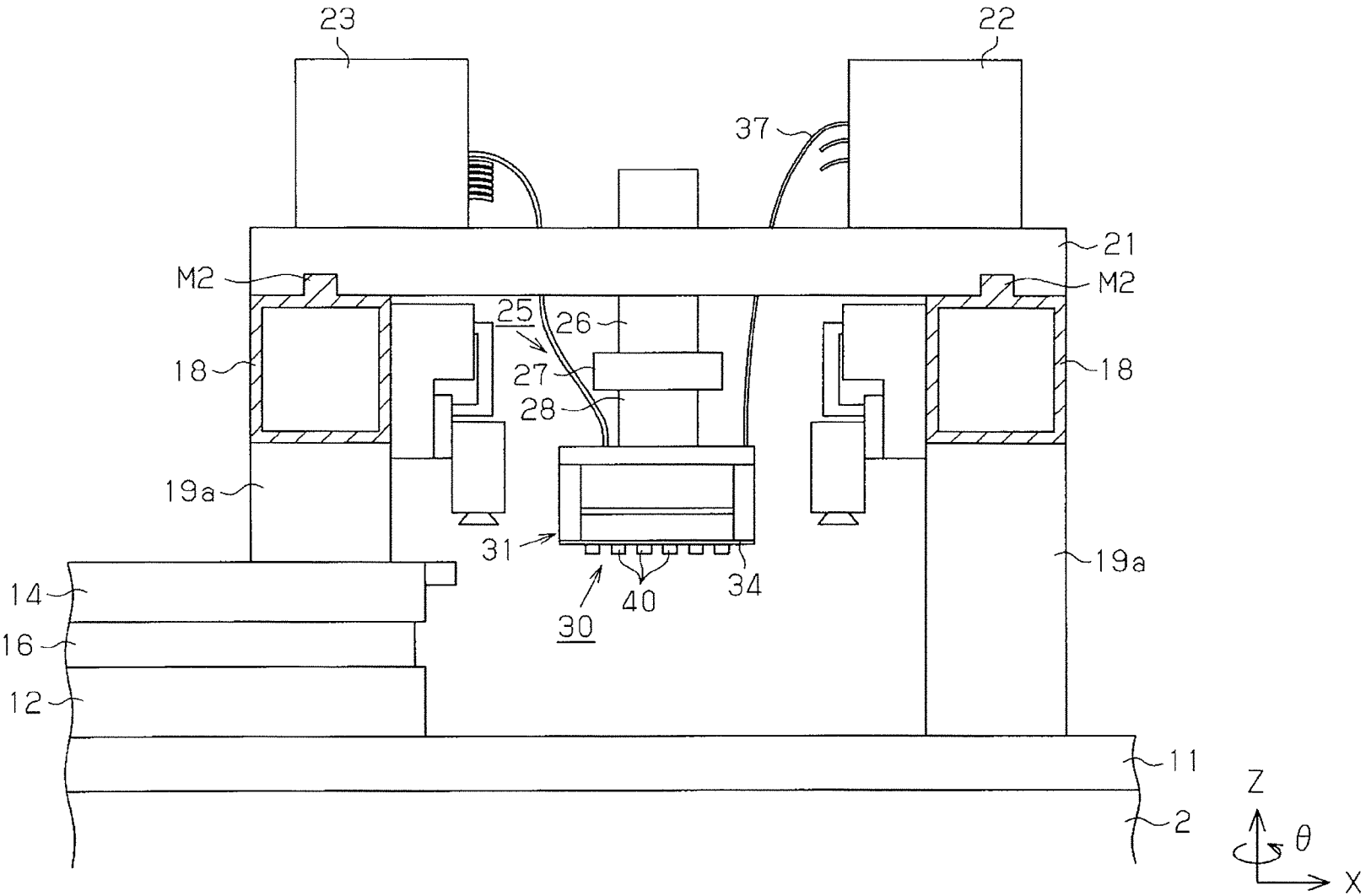
FIG. 2 is a drawing showing the relation between a carriage plate and a carriage.

In FIG. 2, a suspension mechanism 25 is provided in the center on the lower surface of each carriage plate 21. A carriage 30 is attached to the lower edge of the suspension mechanism 25.

The suspension mechanism 25 includes a suspension substrate 26, a suspension rotation frame 27, and a suspension support frame 28. The suspension substrate 26 is connected and fixed to the center of the lower surface of the carriage plate 21. The suspension rotation frame 27 is connected to the lower edge of the suspension substrate 26. The suspension support frame 28 is connected to and supported by the lower edge of the suspension rotation frame 27 in such a manner that the suspension support frame 28 is rotatable in the θ direction. The suspension rotation frame 27 includes a θ axis rotation motor (not shown) and rotates the suspension support frame 28 in the θ direction with respect to the suspension substrate 26 (carriage plate 21) while receiving the driving force of the θ axis rotation motor. The carriage 30 is supported by and fixed to the suspension support frame 28 so that the carriage 30 suspended from the suspension mechanism 25 rotates in the θ direction.

Figure 3:
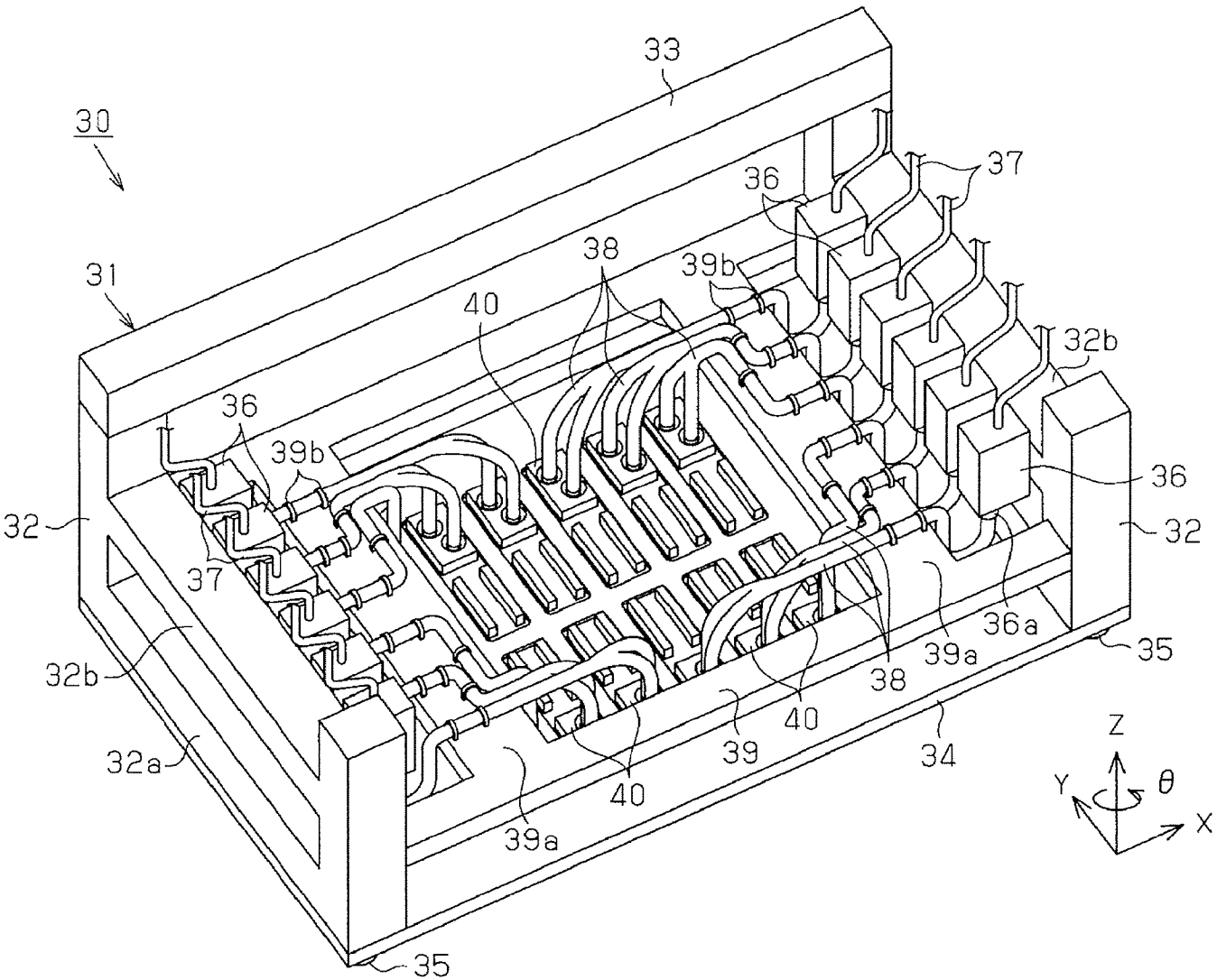
FIG. 3 is a perspective view roughly showing a configuration of the carriage.
Figure 4:
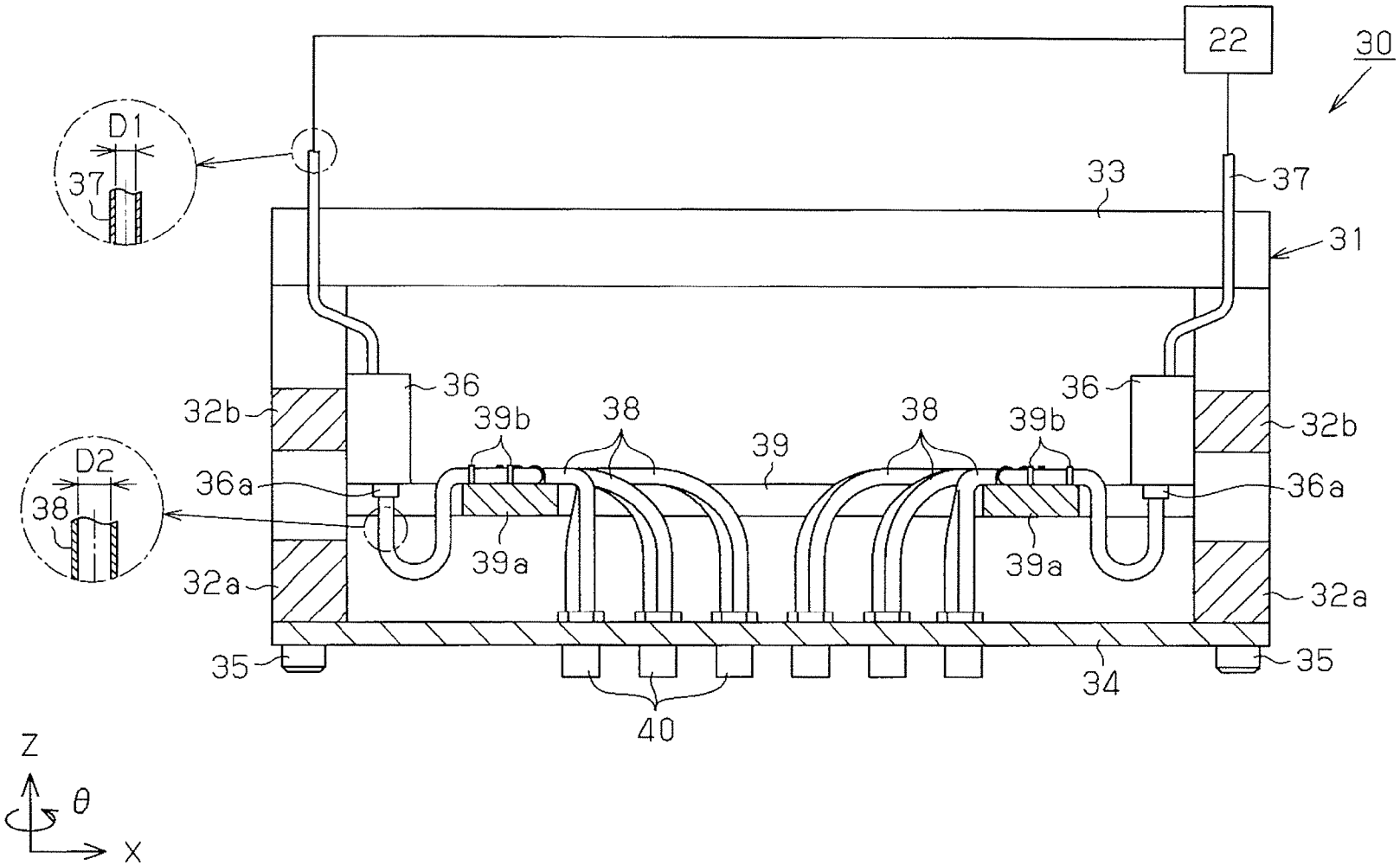
FIG. 4 is a sectional view roughly showing a configuration of the carriage.

Next, the carriage 30 suspended from the suspension mechanism 25 provided in the center of the lower surface of each carriage plate 21 will be described with reference to FIGS. 3 and 4. In FIGS. 3 and 4, the inside of the carriage 30 is shown in a simplified manner for convenience.

In FIGS. 3 and 4, the carriage 30 includes an approximately rectangular parallelepiped carriage frame 31. The carriage frame 31 includes a pair of approximately rectangular carriage side frames 32 disposed in such a manner that the carriage side frames 32 are opposed to each other in the X axis direction and a pair of connection arms 33 (one thereof is shown and the other is omitted) for connecting and fixing the corresponding ends of the upper sides of the carriage side frames 32. The pair of connection arms 33 are connected and fixed to the suspension support frame 28 of the suspension mechanism 25. When the θ axis motor (not shown) rotates in the forward or reverse direction, the carriage frame 31 rotates in the θ direction while receiving the rotation of the suspension support frame 28 in the θ direction.

A unit plate 34 is connected and fixed to the lower sides 32*a* of the pair of carriage side frames 32 using fixing screws 35. Two lines of six droplet discharge heads 40 disposed along the X axis direction are disposed in the Y axis direction on the unit plate 34 along an XY plane, that is, a total of twelve droplet discharge heads 40 are disposed. Each droplet discharge head 40 is fixed to the unit plate 34 with high alignment accuracy. For example, when mounting these many droplet discharge heads 40 on the unit plate 34, first, the positions of the droplet discharge heads 40 with respect to the unit plate 34 are optically detected and then the positions of the droplet discharge heads 40 are fine-tuned on the basis of the detected positions. If the positions of the droplet discharge heads 40 and corresponding target positions are matched optically, the droplet discharge heads 40 and unit plate 34 are instantly bonded together using an adhesive material.

In this embodiment, among the above-mentioned twelve droplet discharge heads 40, six droplet discharge heads 40 disposed in the X axis direction are referred to as a first head group and the other six droplet discharge heads 40 disposed in the reverse X axis direction are referred to as a second head group. The first head group and second head group each include three head lines. Each head line includes a pair of droplet discharge heads 40 disposed in the Y axis direction. The head lines of the first head group include a head line for red, a head line for green, and a head line for blue disposed sequentially in the X axis direction. Similarly, the head lines of the first head group include a head line for red, a head line for green, and a head line for blue disposed sequentially in the X axis direction.

Six pressure control valves 36 are disposed on an upper side 32*b* of each of the carriage side frames 32 along the Y axis direction. Connected to each pressure control valve 36 is a flexible first supply tube 37 (see FIG. 2). Each flexible first supply tube 37 extends from the function liquid supply unit 22 and is intended to supply the function liquid F. Each pressure control valve 36 receives the function liquid F from the function liquid supply unit 22, controls pressure applied to the function liquid F to a predetermined pressure, and lets out the function liquid F.

In this embodiment, among the above-mentioned twelve (six by two) pressure control valves 36, six pressure control valves disposed downstream of the X axis direction are referred to as a first valve group and the other six pressure control valves disposed upstream of the X axis direction are referred to as a second valve group.

The pressure control valves 36 of the first valve group disposed in the Y axis direction receive blue ink, green ink, red ink, red ink, green ink, and blue ink, respectively, supplied from the function liquid supply unit 22. Also, the pressure control valves 36 of the second valve group disposed in the Y axis direction receive red ink, green ink, blue ink, blue ink, green ink, and red ink, respectively, supplied from the function liquid supply unit 22.

Connected to an outlet 36*a* of each pressure control valve 36 is one end of a second supply tube 38. The other end of each second supply tube 38 is bifurcated into two tubes in the corresponding droplet discharge head 40 and the two tubes are connected to two connection needles 42 (see FIG. 5) of the droplet discharge head 40. An inner diameter D2 of each second supply tube 38 is larger than an inner D1 of each first supply tube 37. This makes the flow velocity of the function liquid F in the second supply tube 38 lower than that of the function liquid F in the first supply tube 37 thereby making pressure loss per unit length in the second supply tube 38 smaller than that in the first supply tube 37. That is, the supply pressure of the function liquid F let out from each pressure control valve 36 to the corresponding droplet discharge head 40 is maintained, since the inner diameter D2 is larger than the inner diameter D1.

Two pressure control valves 36 corresponding to blue, of the first valve group are coupled to heads of the head line for blue of the first head group via the corresponding second supply tubes 38. Two pressure control valves 36 corresponding to green, of the first valve group are coupled to heads of the head line for green of the first head group via the corresponding second supply tubes 38. Two pressure control valves 36 corresponding to red, of the first valve group are coupled to heads of the head line for red of the first head group via the corresponding second supply tubes 38.

As such, two pressure control valves 36 corresponding to blue, of the second valve group are coupled to heads of the head line for blue of the second head group via the corresponding second supply tubes 38. Two pressure control valves 36 corresponding to green, of the second valve group are coupled to heads of the head line for green of the second head group via the corresponding second supply tubes 38. Two pressure control valves 36 corresponding to red, of the second valve group are coupled to heads of the head line for red of the second head group via the corresponding second supply tubes 38.

Since the pressure control valves 36 are disposed in the Y axis direction and the head lines for the colors disposed in the Y axis direction are disposed in the X axis direction, the distance between the outlet 36*a* of each pressure control valve 36 and the connection needle 42 of the corresponding droplet discharge head 40 varies with the colors of ink. Differences in the distances between the outlets 36*a* and the corresponding connection needles 42 are compensated for so that the flow path resistances between the outlets 36*a* and the corresponding connection needles 42 are equalized with respect to all the colors. That is, the lengths of the second supply tubes 38 are equalized. Since the flow path resistances in the second supply tubes 38 are equalized, the pressures for supplying the ink let out from the pressure control valves 36 to the droplet discharge heads 40 are equalized regardless of the positions of the droplet discharge heads 40.

Provided between the pair of carriage side frames 32 is a positioning member 39. The positioning member 39 includes a pair of mounting units 39*a* each having an upper surface parallel with the XY plane and extending in the Y axis direction. Each second supply tube 38 connected to the outlet 36*a* of the corresponding pressure control valve 36 is fixed to the upper surface of the corresponding mounting unit 39*a* with a fixing member 39*b*. Thus, the largest distance in the Z direction (vertical direction) between each second supply tube 38 and the corresponding droplet discharge head 40 is controlled to the position of the mounting unit 39*a*. That is, the largest distances between the second supply tubes 38 and the corresponding droplet discharge heads 40 are equalized regardless of the positions of the droplet discharge heads 40. Also, the water heads of the ink from the second supply tubes 38 to the corresponding droplet discharge heads 40 are equalized.

Figure 5:
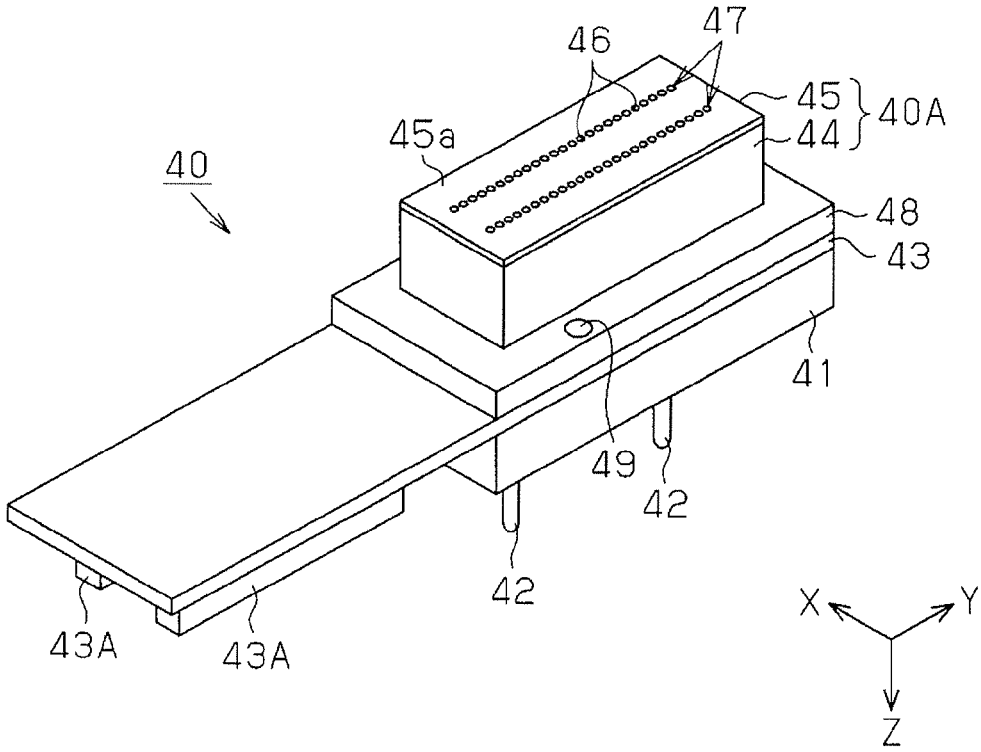
FIG. 5 is a perspective view of a droplet discharge head.
Figure 6:
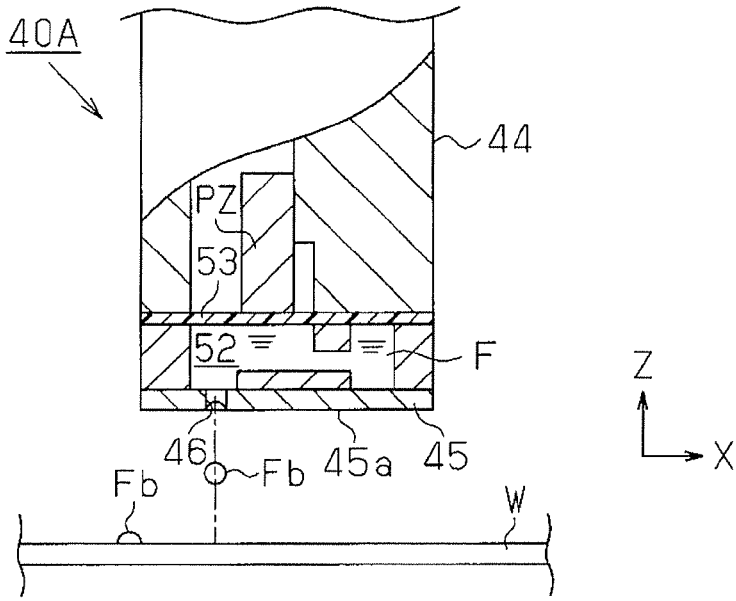
FIG. 6 is a sectional view of the droplet discharge head.
Figure 7:
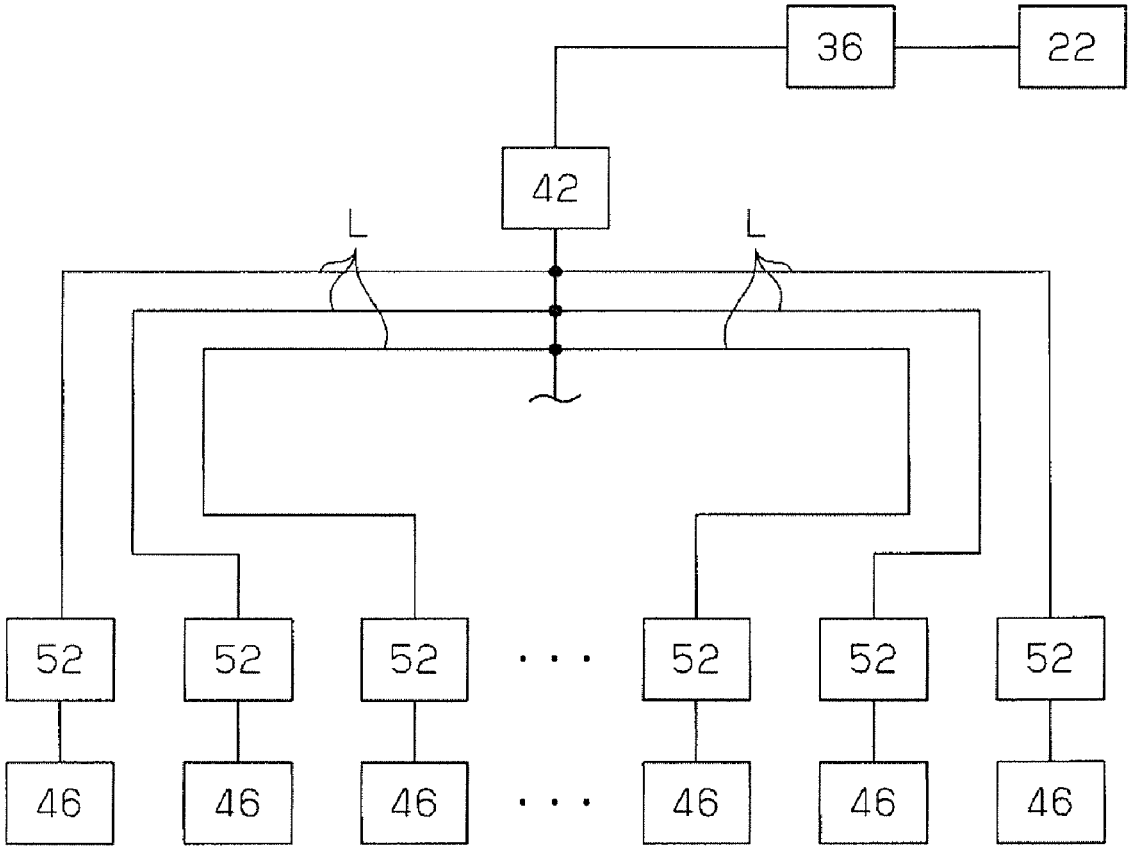
FIG. 7 is a schematic diagram showing the lengths of flow paths from a connection needle to nozzles.

Next, the droplet discharge heads 40 will be described with reference to FIGS. 5 to 7. FIG. 5 is an external perspective view of one of the droplet discharge heads seen from the substrate stage 14. FIG. 6 is a drawing showing the inside of a pump 44 of the droplet discharge head 40. FIG. 7 is a diagram schematically showing the lengths of flow paths from the connection needle 42 to discharge nozzles 46 in the droplet discharge head 40.

The droplet discharge head 40 includes a liquid injection unit 41 having two connection needles 42, a head substrate 43 connected to a side of the liquid injection unit 41, the pump 44 connected to the liquid injection unit 41, and a nozzle plate 45 connected to the pump 44. In this embodiment, the pump 44 and nozzle plate 45 constitute a rectangular parallelopiped head body 40A.

Connected to the connection needle 42 of the liquid injection unit 41 is the second supply tube 38 (see FIGS. 3 and 4). Mounted on the head substrate 43 are a pair of head connectors 43A, through which a flexible flat cable (not shown) is coupled to the head substrate 43.

Formed on a nozzle formation surface 45*a* of the nozzle plate 45 are two nozzle lines 47 including the discharge nozzles 46 for discharging droplets Fb. The two nozzle lines 47 are disposed so as to be parallel with each other and each include 180 discharge nozzles 46 disposed in parallel at equal intervals. That is, the two nozzle lines 47 are disposed on the nozzle formation surface 45*a* of the head body 40A in such a manner that the two nozzle lines 47 are symmetric with respect to the center line of the nozzle formation surface 45*a*.

Provided above each discharge nozzle 46 are a cavity 52, a diaphragm 53, and a piezoelectric element PZ. Each cavity 52 is coupled to the function liquid supply unit 22 via the corresponding second supply tube 38, pressure control valve 36, and first supply tube 37. Each cavity 52 stores the function liquid F (ink) supplied from the function liquid supply unit 22 and provides the ink to the corresponding discharge nozzle 46. Each diaphragm 53 expands and contracts the volume of the corresponding cavity 52 by vibrating an area of the diaphragm 53 opposed to the cavity 52 in the Z direction, thereby vibrating the meniscus of the discharge nozzle 46. Each piezoelectric element PZ contracts and expands in the Z direction when receiving a predetermined drive signal, thereby vibrating areas of the corresponding diaphragm 53 in the Z direction. When each diaphragm 53 vibrates in the Z direction, the corresponding cavity 52 discharges a part of the ink stored in the cavity 52 in the form of a droplet Fb from the corresponding discharge nozzle 46.

A rectangular parallelopiped flange 48 is formed below a base of the pump 44, that is, below a base of the head body 40A so that the unit plate 34 receives the liquid injection unit 41. The flange 48 has a screw hole 49 for a small screw used when temporarily fixing the droplet discharge head 40 to the unit plate 34. The droplet discharge head 40 is position-controlled as described above in a state in which the droplet discharge head 40 is temporarily fixed to the unit plate 34.

As shown in FIG. 7, in the droplet discharge heads 40, the lengths of the flow paths L between the connection needle 42 and cavities 52 are equalized so that the resistances of flow paths from the connection needle 42 to the cavities 52 are equalized. Accordingly, the droplet discharge apparatus 1 is allowed to equalize the resistances of flow paths from the pressure control valves 36 to the corresponding discharge nozzles 46 thereby improving the uniformity in the supply pressures of the ink to the discharge nozzles 46. This allows the droplet discharge apparatus 1 to improve the uniformity in the amounts of droplets Fb discharged from the discharge nozzles 46.

By adopting the above-mentioned embodiment, the following advantages are obtained.

(1) In the droplet discharge apparatus 1 according to the above-mentioned embodiment, the pressure control valves 36 and corresponding droplet discharge heads 40 are coupled via the second supply tubes 38 having an identical length. Accordingly, the uniformity in the flow path resistances in the second supply tubes 38 connecting the pressure control valves 36 and corresponding connection needles 42 is improved. As a result, the droplet discharge apparatus 1 is allowed to improve the uniformity in the pressures for supplying the ink to the droplet discharge heads 40. This improves the uniformity in the amounts of droplets Fb discharge from the droplet discharge heads 40.

(2) In the droplet discharge apparatus 1 according to the above-mentioned embodiment, the carriage 30 is provided with the positioning member 39 and the largest distances in the Z direction between the second supply tubes 38 and the corresponding droplet discharge heads 40 are equalized. Accordingly, the droplet discharge apparatus 1 is allowed to further improve the uniformity in the supply pressures of the ink in the second supply tubes 38 to the corresponding droplet discharge heads 40. This improves the uniformity in the amounts of droplets Fb discharge from the droplet discharge heads 40.

(3) In the droplet discharge apparatus 1 according to the above-mentioned embodiment, the inner diameter D2 of each second supply tube 38 is made larger than the inner diameter D1 of each first supply tube 37. Accordingly, the droplet discharge apparatus 1 is allowed to maintain the supply pressure of the ink controlled using the pressure control valves 36 since the pressure loss in each second supply tube 38 is made smaller than that in each first supply tube 37. This allows the droplet discharge apparatus 1 to further improve the uniformity in the supply pressures of the ink to the droplet discharge heads 40.

(4) In the droplet discharge apparatus 1 according to the above-mentioned embodiment, the lengths of the flow paths L connecting the connection needles 42 and the corresponding cavities 52 are equalized so that the resistances of flow paths from the connection needles 42 to the cavities 52 are equalized. Accordingly, the resistances of flow paths from the pressure control valves 36 to the corresponding discharge nozzles 46 are equalized. This improves the uniformity in the supply pressures of the ink to the discharge nozzles 46. As a result, the droplet discharge apparatus 1 is allowed to improve the uniformity in the amounts of droplets Fb discharged from the discharge nozzles 46.

The following changes may be made to the above-mentioned embodiment.

While the lengths of the flow paths L in each droplet discharge head 40 are equalized in the above-mentioned embodiment, the lengths of the flow paths L may be different from each other as long as the uniformity in the supply pressures of the ink to the droplet discharge heads 40 is improved.

While the inner diameter D2 of each second supply tube 38 is made larger than the inner diameter D1 of each first supply tube 37 in the above-mentioned embodiment, the inner diameter D2 of each second supply tube 38 may be equal to or smaller than the inner diameter D1 of each first supply tube 37 as long as the uniformity in the flow path resistances in the second supply tubes 38 is improved.

The lengths of all the second supply tubes 38 are equalized in the above-mentioned embodiment, but not limited thereto. The lengths of the second supply tubes 38 may be equalized for each of the types of function liquids. Accordingly, the lengths of the second supply tubes 38 does not need to be equalized with respect to different types of function liquid as long as the discharge amounts are made uniform with respect to an identical type of function liquid.

While the largest distances in the Z direction between the second supply tubes 38 and the corresponding droplet discharge heads 40 are equalized in the above-mentioned embodiment, this configuration may be omitted as long as the hermeticity between each pressure control valve 36 and corresponding droplet discharge head 40 is secured.

In the above-mentioned embodiment, the function liquid F is supplied from one pressure control valve 36 to one droplet discharge head 40, but limited thereto. The function liquid F may be supplied from one pressure control valve 36 to multiple droplet discharge heads 40. This reduces the number of pressure control valves 36 thereby reducing the size of the apparatus.

In the above-mentioned embodiment, the invention is embodied as the droplet discharge apparatus 1 that discharges any one of three types of ink, which are function liquids, from each droplet discharge head 40 in the form of droplets, but limited to thereto. For example, the invention may be embodied as a droplet discharge apparatus that discharges an identical type of function liquid from each droplet discharge head 40.

In the above-mentioned embodiment, each carriage 30 of the droplet discharge apparatus 1 is provided with twelve droplet discharge heads 40 and the pair of Y axis guide rails 18 are provided with six carriages, but limited thereto. In the droplet discharge apparatus 1, the disposition or number of droplet discharge heads mounted on a carriage and the number of carriages may be changed as appropriate. That is, a droplet discharge apparatus may have any configuration as long as the droplet discharge apparatus is provided with multiple pressure control valves 36 and multiple droplet discharge heads 40.

In the above-mentioned embodiment, the droplet discharge apparatus 1 is an apparatus for forming color filters, but not limited thereto. A droplet discharge apparatus may be an apparatus for forming metal wiring lines, an apparatus for forming insulating layers, an apparatus for forming liquid crystal layers or alignment layers, or an apparatus for forming light-emitting layers or transportation layers of organic electroluminescent displays. That is, it is sufficient that a droplet discharge apparatus is an apparatus for discharging a function liquid onto a target as a droplet so that the droplet discharged on the target exhibits a function.

In the above-mentioned embodiment, the invention is embodied as the piezoelectric element drive-type droplet discharge heads 40, but limited to thereto. The invention may be embodied as resistance heating-type or electrostatic drive-type droplet discharge heads.

The entire disclosure of Japanese Patent Application No. 2008-80656, filed Mar. 26, 2008 is expressly incorporated by reference herein.

What is claimed is:

1. A droplet discharge apparatus comprising:

a tank for storing a function liquid;

a first supply tube for supplying the function liquid;

a plurality of pressure control valves for controlling a pressure of the function liquid supplied from the tank via the first supply tube, to a predetermined pressure and then letting out the function liquid;

a plurality of droplet discharge heads for discharging the function liquid let out from the pressure control valves in the form of droplets; and a plurality of second supply tubes for connecting outlets of the pressure control valves and inlets of the droplet discharge heads so that the function liquid let out from the pressure control valves is supplied to the droplet discharge heads, wherein distances between the outlets and the corresponding inlets are different from one another, and lengths of the second supply tubes are equalized so that resistances of flow paths between the outlets and the corresponding inlets are equalized.

2. The droplet discharge apparatus according to claim 1, wherein the tank supplies different types of function liquids to the pressure control valves, and lengths of the second supply tubes are equalized with respect to each of the types of the function liquids.

3. The droplet discharge apparatus according to claim 2, wherein the lengths of the second supply tubes are equalized with respect to all the types of function liquids.

4. The droplet discharge apparatus according to claim 1, wherein an inner diameter of each of the second supply tubes is larger than an inner diameter of the first supply tube connecting the tank and the pressure control valves.

5. The droplet discharge apparatus according to claim 1, wherein largest distances in a vertical direction between the second supply tubes and the corresponding droplet discharge heads are equalized.

6. The droplet discharge apparatus according to claim 1, wherein each of the droplet discharge heads has a plurality of nozzles for discharging the droplets and a plurality of flow paths for connecting the nozzles and the corresponding inlet, and resistances of the flow paths are equalized.

* * * * *